United States Patent [19]

Jansz

[11] 4,151,888

[45] May 1, 1979

[54] SUBMERGIBLE PILE DRIVER WITH EXTENSION TUBE TO ACCOMMODATE TENSIONED CABLE STRING LOOPS

[75] Inventor: Joost W. Jansz, The Hague, Netherlands

[73] Assignee: Hollandsche Beton Groep N.V., Rijswijk, Netherlands

[21] Appl. No.: 900,377

[22] Filed: Apr. 26, 1978

[30] Foreign Application Priority Data

Apr. 28, 1977 [NL] Netherlands ..... 7704694

[51] Int. Cl.[2] ..... B23Q 5/00

[52] U.S. Cl. ..... 173/160; 173/DIG. 1; 405/232

[58] Field of Search ..... 173/147, 151, 160, DIG. 1; 405/232

[56] References Cited

U.S. PATENT DOCUMENTS

| | | | |
|---|---|---|---|
| 2,730,332 | 1/1956 | Hale | 173/147 |
| 2,886,290 | 5/1959 | Brennan et al. | 173/160 X |
| 3,162,253 | 12/1964 | Curtis | 173/147 |
| 3,927,722 | 12/1975 | Frederick | 405/232 X |
| 3,991,581 | 11/1976 | Kolb | 405/227 |
| 4,035,969 | 7/1977 | Casagrande | 405/232 X |

FOREIGN PATENT DOCUMENTS

| | | |
|---|---|---|
| 1310962 | 10/1962 | France. |
| 1329330 | 4/1963 | France. |
| 7512023 | 10/1975 | Netherlands. |
| 7514331 | 12/1975 | Netherlands. |

*Primary Examiner*—Lawrence J. Staab

*Attorney, Agent, or Firm*—Sughrue, Rothwell, Mion, Zinn and Macpeak

[57] ABSTRACT

An elongated hollow tube 2 is secured to the top of a pile driver 1, and the assembled unit is lowered to the head of an anchoring pile 12on the sea bottom via spaced guide rings 13 on a submerged tower 10. The flexible hose string 5 for conveying hydraulic, electric, pneumatic, etc. power and control to the pile driver is accommodated in a loop fashion within the tube 2 via a weighted and floating pulley(s) 7, and feeds out during the lowering of the unit through guide rings 13 spaced on the tower over a pulley 4 mounted on a detachable surface ring 3. The various hoses and cables in the string 5 are maintained in a parallel relation by periodic clamping means 14, and smooth surface reel winding is implemented by periodic spacers 26 secured to the outboard tension cables 15, 16 in the string.

8 Claims, 10 Drawing Figures

SUBMERGIBLE PILE DRIVER WITH EXTENSION TUBE TO ACCOMMODATE TENSIONED CABLE STRING LOOPS

BACKGROUND OF THE INVENTION

This invention relates to an apparatus for subaqueous pile driving at considerable depths comprising a pile driving block, means for lifting and lowering the block from a position above the water line, and means for guiding the block during ascent or descent. Hoses and cables for supplying energy, air, etc. to the submerged pile driver are also provided.

In known devices of this kind the pile driving block is lifted and lowered by hoisting means on board a floating barge or the like via guide means on a stationary underwater platform or tower. The guide means are typically spaced along the framework of the platform and serve to guide the pile and the pile driving means during their lowering.

To supply energy to and control the operation of the pile driving block and to provide air in the region where the ram strikes the head of the pile, hoses and cables are needed which must also be guided from above the water line down to the pile driving block. These hoses and cables present a problem in that they must move from a position above the water line in synchronism with the movement of the hoisting means and with the reciprocating movements resulting from the pile driving operation, and in most cases such hoses and cables are not adapted to take considerable tensile stresses. This deficiency may cause problems when the apparatus for guiding the hoses and cables is disposed on a floating barge or the like which is exposed to wind and wave action. In addition, the cables may become entangled by underwater currents, not only with each other but also with the guiding means, particularly when the latter comprise guide rings disposed along the framework of a stationary submerged platform or tower. Not only the pile and the pile driving block but also the hoses and cables must be guided through such rings.

SUMMARY OF THE INVENTION

It is the object of this invention to provide an apparatus which overcomes any problems arising from the handling of the hoses and cables during lowering and recovery. In accordance with the invention, said object is achieved in that an elongated hollow tube is secured on top of the pile driver block, and the hoses, cables and the like are accommodated in said tube in a looped or bight fashion. The hoses have a length which is a multiple of the length of the tube.

The hoses and cables are protected by their accommodation within the tube. As the pile driving block is lowered below the water surface the hoses and cables are pulled out of the tube while at the same time remaining relatively taut. Thus, their movement in synchronism with the hoisting means is no longer required, and their necessary tension is automatically controlled as they are pulled out of the storage tube.

Moreover, the tube acts as an extension of the pile driving block when it is lowered through guide rings spaced along the framework of the platform. For proper guidance the pile and the pile driving head must always be disposed through at least two guide rings. The length of the pile driving head, however, is generally shorter than the distance between the guide rings.

The tube thus creates an extension by which the guidance of the pile driving block through at least two rings is guaranteed.

The hoses and cables, or hose string, have a fixed point of connection in the proximity of the upper end of the tube, from which point there are fixed connections to the pile driving block. The hose string runs down and up again from said connection point over one or more pulleys, the lowest one(s) being vertically movable in the tube and downwardly biased by attached weights or the like. Thus, the hose string remains properly positioned inside the tube and is kept taut during lowering and lifting.

When only one weighted or floating pulley is used in the lower section of a tube having a length of e.g. 50 m, approximately 100 m of hose string may be loop stored in the tube and an additional length of approximately 50 m may remain outside the tube. If several floating pulleys are used, the hose string length can be increased accordingly.

The tube offers sufficient hose string storage room since the typical pile driving block has a diameter between 1½ and 2 m, and the tube has approximately the same diameter.

The end section of the hose string leaving the tube runs over a pulley supported on a detachable ring disposed on top of the tube. During the lowering process the detachable ring remains behind on a guide ring lying above the water surface on a vessel or platform, so that the correct position and proper guidance of the upwardly running cable section is guaranteed.

A considerable advantage of the invention is that automatic compensation for ocean swells or waves is obtained.

The hoses and cables are preferably combined to form a flat string wherein the cables run parallel to each other and the center lines lie in a common plane. The string is provided with transverse clamping means at regular distances each one holding all the cables and hoses passing therethrough. Said string contains high-pressure hoses, low-pressure hoses, air pressure lines whose value depends on the depth of operation, electric lines, etc. By so combining the hoses and cables in a parallel manner by equally spaced clamping means, elongations and shortenings under the influence of pressures neutralize each other in the short length regions between the clamping means. Desirably, steel tension cables may be provided in the hose string.

The hose string sections are preferably connected to each other by means of hose couplings, whereby in case of repair only short sections need be repaired and replaced.

In order to achieve a smooth and even winding and reeling of the hose string the cables are preferably provided with spacers between the clamping means having a thickness at least equal to the thickness of the clamping means.

For operations at considerable distances it is conceivable that a hose string of this type must be delivered to a far away field of activity in an extremely short time. The invention therefore contemplates disposing the hose string on a self-powered or self-driving reel, if required, and filling and closing the hoses with working fluid.

Thus, on the arrival of a reel of this kind at the working scene it is only needed to make the necessary connections to the pile driving head.

DETAILED DESCRIPTION OF THE PREFERRED EMBODIMENTS

Figure 1:
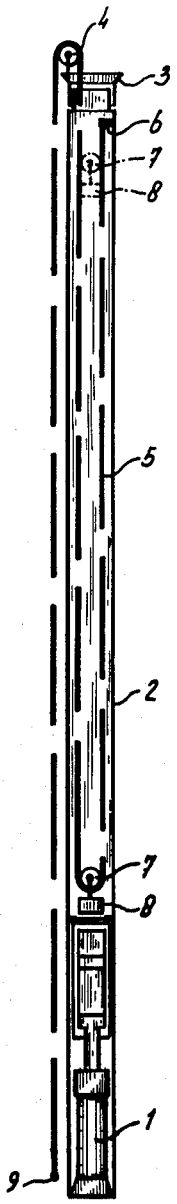
FIG. 1 shows a diagrammatic side view of a submergible pile driving apparatus according to one embodiment of the invention.

FIG. 1 shows a pile driver 1 mounted to the bottom of an elongated hollow tube 2 having a detachable adapter ring 3 on its upper end carrying a rotatable pulley 4.

A hose string 5 is loop disposed in the tube 2 and is attached at one end to a connector fitting 6. Lines (not illustrated) are rigidly connected to the fitting 6 and run along the tube wall to the pile driver 1. The hose string initially runs down from fitting 6 over a floating or freely movable pulley 7 loaded by a weight 8, and then up over the pulley 4 to the outside of the tube. When in use, the end section 9 of the string 5 is coupled to appropriate power and supply sources on a floating barge or the like, as shown in FIG. 2.

Figure 2:
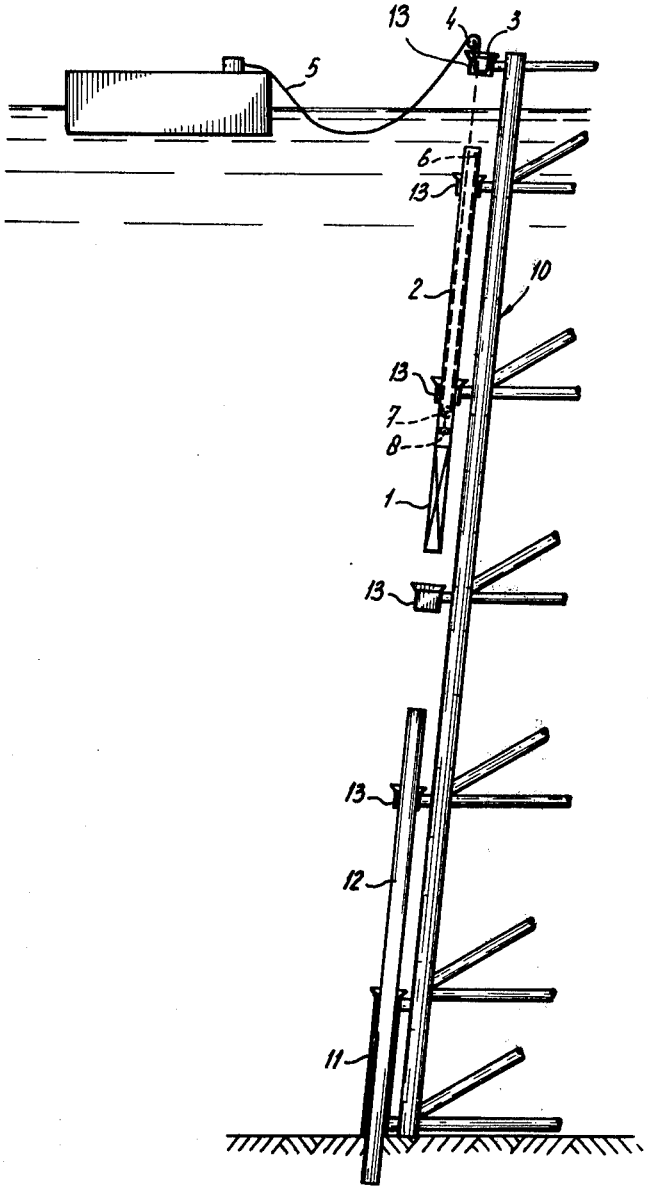
FIG. 2 shows the apparatus of FIG. 1 being lowered through a stationary submerged tower.
Figure 3:
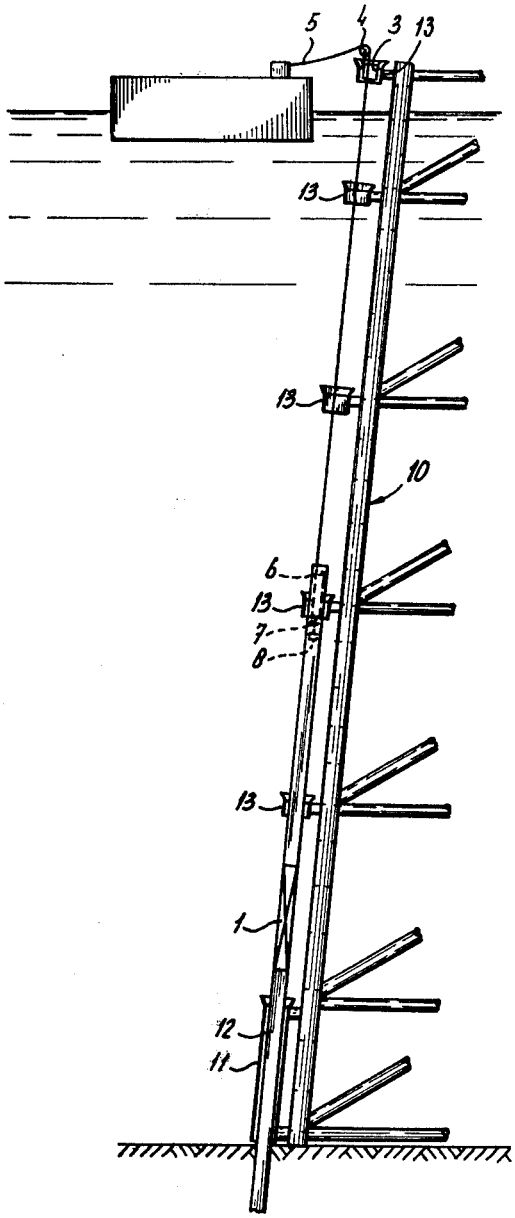
FIG. 3 shows the apparatus in its fully lowered position.

FIGS. 2 and 3 show a practical application of the apparatus, wherein a platform 10 has been positioned on the ocean floor and around its base carries tubes 11 through which piles 12 must be driven into the ocean floor. The piles have been lowered by hoisting devices (not illustrated), and are guided by rings 13 secured to the exterior of the platform at regular intervals — usually determined by the strut connections of the frame. The pile driver 1 and the tube 2 may now be lowered via the guide rings 13 in the same manner and disposed on the head of the pile (see FIG. 3). Because of its length, the tube 2 will always extend between at least two guide rings, and its diameter is substantially the same as that of the pile driver 1. During the process of lowering, the hose string 5 coupled at one end to the floating barge will gradually be withdrawn from the tube 2, as seen by comparing FIGS. 2 and 3.

The illustrated Figures are based on a water depth of 150 m and a pile driver length (including the tube 2) of 60 m, so that with the hose string completely withdrawn from the tube sufficient length will be available for operation at such depth. FIG. 3 shows the final lowered position of the pile driver.

During the lowering of the pile driver 1 and the tube 2 the detachable ring 3 and pulley 4 remain behind on the upper guide ring 13.

FIGS. 2 and 3 illustrate a working application using a stationary platform. However, it is also possible to secure anchors or the like on the ocean floor at greater depths using the same system by lowering the pile driver and tube from a floating barge via guide rods or cables disposed on the barge and running towards the area of operation.

Figure 4:
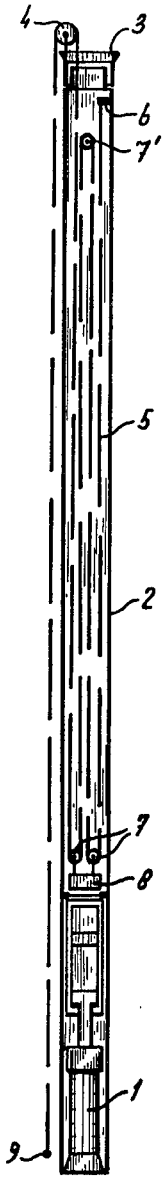
FIG. 4 shows a side view of a further embodiment.

FIG. 4 is a variant of the device shown in FIG. 1, in which two floating pulleys 7 are used as well as a stationary mounted pulley 7′ in the upper section of the tube. In this embodiment a hose string 5 nearly twice as long as in the first embodiment can be accommodated in the tube.

Figure 5:
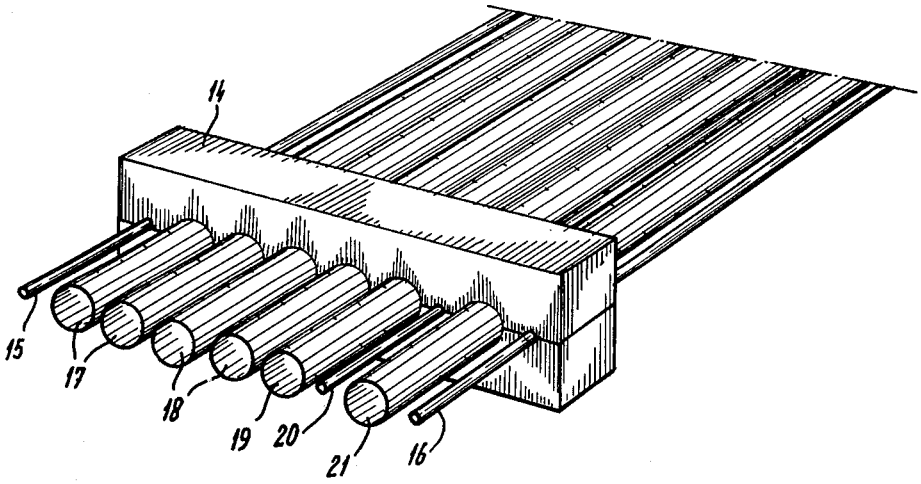
FIG. 5 shows a perspective view of part of a hose string.

FIG. 5 shows part of a hose string 5 with a clamping means 14 comprising two half portions secured to each other to hold two steel cables 15, 16, two high pressure oil lines 17, two low pressure oil lines 18, an air line 19, an electric wire 20 and a high pressure line 21, thus preventing their relative twisting during handling.

Figure 6:
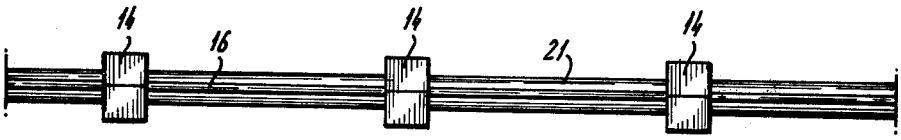
FIG. 6 shows a side view of the hose string.

FIG. 6 is a side view of a hose string section provided with several spaced clamping means 14.

Figure 7:
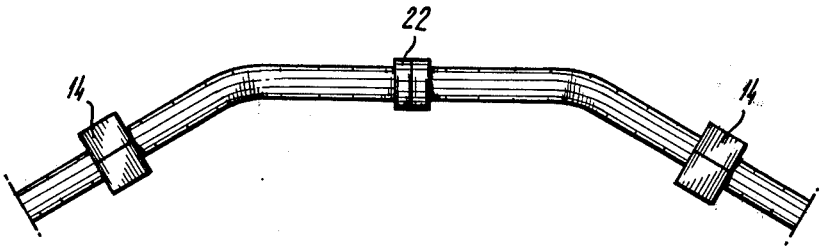
FIG. 7 shows a coupled hose string.

FIG. 7 shows a similar section of the string with clamping means 14, comprising in addition a coupling 22 for the hose sections. As a result of the hose coupling there are straight portions in the string on either side of the coupling because each half section of the coupling has a supporting post.

Figure 8:
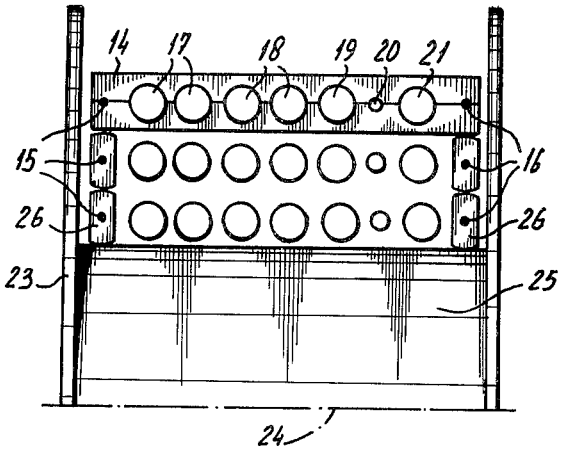
FIGS. 8, 9 and 10 show sectional, top and cross-sectional views of a winding reel for the hose string.

FIG. 8 shows part of a winding reel 23 having a center line 24 and a core 25. A hose string of the type illustrated in FIG. 5 has been wound between the end flanges of the reel, and periodic spacers 26 are provided on the steel cables 15, 16 to keep the wound hoses at a proper distance from each other. This is advisable because during winding the clamping means 14 will not always lie on top of each other but rather will fall between each other and would then be in pinch-off contact with the hose sections.

Figure 9:
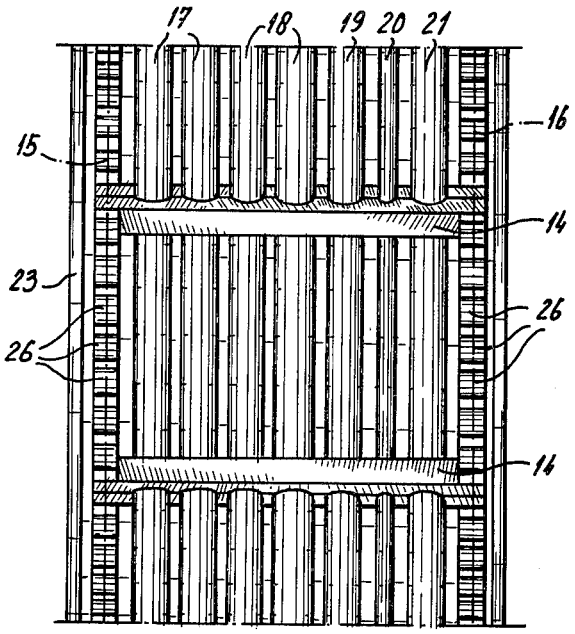
Figure 10:
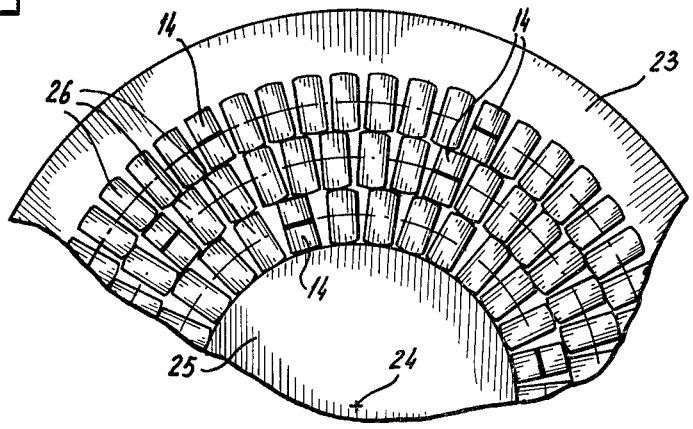

FIG. 9 shows the position of the spacers 26 lying between the clamping means 14, and FIG. 10 is a sectional view through the reel axis showing the position of the spacers 26 and clamping means 14 lying on top of each other. Because of these spacers hose couplings with short straight sections as illustrated in FIG. 7 do not cause any problems during winding and reeling.

What is claimed is:

1. An apparatus for submergible pile driving including a pile driver, means for lifting and lowering the pile driver from a position above the water surface to and from an underwater working position, means for guiding the pile driver during its ascent and descent, and a hose and cable string for supplying energy, air, control signals, etc. from a source above the water surface to the pile driver, characterized by an elongated hollow tube secued to the top of the pile driver, means for accommodating said string in said tube in a tensioned, variable length loop, the length of said string being a multiple of the length of said tube.

2. An apparatus as defined in claim 1, wherein one end of said string is fixedly secured proximate the upper end of said tube, and said string runs down from said point of secural over a weighted, freely floating pulley disposed in said tube and then back up to the open top end thereof, said string thus constituting a variable length, downwardly biased bight.

3. An apparatus as defined in claim 2, wherein the upper end of said string leaves the tube over a pulley mounted on a detachable ring disposed on the top of said tube.

4. An apparatus as defined in claims 1, 2 or 3, wherein the diameter of the tube does not exceed that of the pile driver.

5. An apparatus as defined in claim 4, wherein the cables and hoses in said string form a generally flat configuration wherein the cables run parallel to each other and their center lines lie in a common plane, said string having a plurality of transverse clamping means at regular intervals each holding all of the cables and hoses passing therethrough.

6. An apparatus as defined in claim 5, wherein at least two steel tensioning cables run parallel to the hoses in said string on the outer side thereof, said tensioning cables also being coupled to said clamping means.

7. An apparatus as defined in claim 5, wherein said string comprises sections connected to each other by coupling means.

8. An apparatus as defined in claim 6, wherein the tensioning cables have spacers between the clamping means whose thickness is at least equal to the thickness of the clamping means.

* * * * *